US011628500B2

(12) United States Patent
Horino et al.

(10) Patent No.: US 11,628,500 B2
(45) Date of Patent: Apr. 18, 2023

(54) MANUFACTURING APPARATUS FOR METAL POWDER AND MANUFACTURING METHOD THEREOF

(71) Applicant: TDK CORPORATION, Tokyo (JP)

(72) Inventors: Kenji Horino, Tokyo (JP); Kazuhiro Yoshidome, Tokyo (JP); Akihiro Harada, Tokyo (JP); Hiroyuki Matsumoto, Tokyo (JP)

(73) Assignee: TDK CORPORATION, Tokyo (JP)

( * ) Notice: Subject to any disclaimer, the term of this patent is extended or adjusted under 35 U.S.C. 154(b) by 10 days.

(21) Appl. No.: 17/363,109

(22) Filed: Jun. 30, 2021

(65) Prior Publication Data

US 2021/0323064 A1 Oct. 21, 2021

Related U.S. Application Data

(62) Division of application No. 16/030,993, filed on Jul. 10, 2018, now Pat. No. 11,084,094.

(60) Provisional application No. 62/542,351, filed on Aug. 8, 2017.

(51) Int. Cl.
*B22F 9/08* (2006.01)

(52) U.S. Cl.
CPC ..... *B22F 9/082* (2013.01); *B22F 2009/0872* (2013.01)

(58) Field of Classification Search
CPC ..... B22F 2009/0872
See application file for complete search history.

(56) References Cited

U.S. PATENT DOCUMENTS

| | | | |
|---|---|---|---|
| 4,648,820 | A | 3/1987 | Scruggs et al. |
| 5,180,539 | A | 1/1993 | Yoshino et al. |
| 5,352,267 | A | 10/1994 | Yoshino et al. |
| 5,482,632 | A | 1/1996 | Lomasney et al. |
| 6,336,953 | B1 | 1/2002 | Kikukawa et al. |
| 9,702,028 | B2 | 7/2017 | Otsuka et al. |
| 10,328,492 | B2 | 6/2019 | Kaneta et al. |
| 2007/0138712 | A1 | 6/2007 | Nakabayashi et al. |
| 2014/0238192 | A1 | 8/2014 | Otsuka et al. |
| 2017/0239731 | A1 | 8/2017 | Kaneta et al. |

FOREIGN PATENT DOCUMENTS

| | | | |
|---|---|---|---|
| GB | 1 452 510 | A | 10/1976 |
| GB | 2565653 | A | 2/2019 |
| GB | 2565654 | A | 2/2019 |

(Continued)

OTHER PUBLICATIONS

Dec. 18, 2018 Office Action issued in UK Patent Application No. 1812899.1.

(Continued)

*Primary Examiner* — Brian D Walck
(74) *Attorney, Agent, or Firm* — Oliff PLC

(57) ABSTRACT

A metal powder producing apparatus comprising a melted metal supplying part discharging a melted metal, a cylinder body provided below the melted metal supplying part, and a cooling liquid layer forming part forming a flow of a cooling liquid for cooling the melted metal discharged from the melted metal supplying part along an inner circumference face of the cylinder body, wherein the cooling liquid layer forming part has a primary pressure reservoir, and the primary pressure reservoir is provided on an outer circumference part of the cylinder body.

6 Claims, 6 Drawing Sheets

(56) References Cited

FOREIGN PATENT DOCUMENTS

| | | | |
|---|---|---|---|
| GB | 2565655 | A | 2/2019 |
| JP | S49-98758 | A | 9/1974 |
| JP | S55-82702 | A | 6/1980 |
| JP | S61-44111 | A | 3/1986 |
| JP | H04-17605 | A | 1/1992 |
| JP | H10-072605 | A | 3/1998 |
| JP | H11-080812 | A | 3/1999 |
| JP | 2001-064704 | A | 3/2001 |
| JP | 2002-346377 | A | 12/2002 |
| JP | 2009-275269 | A | 11/2009 |
| JP | 2010-090410 | A | 4/2010 |
| JP | 2010-090411 | A | 4/2010 |
| JP | 2010-090421 | A | 4/2010 |
| JP | 6323602 | B1 | 5/2018 |
| JP | 6323603 | B1 | 5/2018 |
| JP | 6323604 | B1 | 5/2018 |
| JP | 6330958 | B1 | 5/2018 |
| JP | 6330959 | B1 | 5/2018 |
| TW | 200732065 | A | 9/2007 |
| WO | 00/38865 | A1 | 7/2000 |
| WO | 2015/114838 | A1 | 8/2015 |

OTHER PUBLICATIONS

Dec. 18, 2018 Office Action issued in UK Patent Application No. 1812898.3.

Dec. 18, 2018 Office Action Issued in UK Patent Application No. 1812897.5.

Dec. 6, 2018 Office Action Issued in TW Patent Application No. 107127357.

Nov. 30, 2018 Office Action issued in TW Patent Application No. 107127359.

Nov. 14, 2017 Office Action issued in JP Patent Application No. 2017-153076.

Nov. 14, 2017 Office Action issued in JP Patent Application No. 2017-153066.

Nov. 14, 2017 Office Action issued in JP Patent Application No. 2017-153073.

Nov. 14, 2017 Office Action Issued in JP Patent Application No. 2017-153081.

Nov. 14, 2017 Office Action issued in JP Patent Application No. 2017-153077.

Apr. 9, 2020 Restriction/Election issued in U.S. Appl. No. 16/030,993.

Jun. 23, 2020 Office Action issued in U.S. Appl. No. 16/030,993.

MANUFACTURING APPARATUS FOR METAL POWDER AND MANUFACTURING METHOD THEREOF

RELATED APPLICATION

This application is a Divisional of U.S. patent application Ser. No. 16/030,993 filed Jul. 10, 2018. The disclosure of the prior application is hereby incorporated by reference herein in its entirety.

BACKGROUND OF THE INVENTION

1. Field of the Invention

The present invention relates to a metal powder producing apparatus and the method of producing a metal powder.

2. Description of the Related Art

The metal powder producing apparatus and the production method using the apparatus for producing the metal powder which uses so called gas atomization method is known, for example as shown in JP Patent Application Laid Open No. H11-80812. The conventional apparatus has a melted metal supplying container which discharges the melted metal, a cylinder body provided below this melted metal supplying container, and a cooling liquid layer forming part which forms a flow of a cooling liquid supplying part along an inner circumference face of the cylinder body for cooling the melted metal discharged from the melted metal supplying part.

The cooling liquid layer forming part sprays the cooling liquid towards the tangent line direction of the inner circumference face of a cooling cylinder body, then the cooling liquid flows down while spiraling along the inner circumference face of the cooling container, thereby the cooling liquid layer is formed. By using the cooling liquid layer, a melted drop is rapidly cooled, and the metal powder having a high functionality is expected to be produced.

However, for the conventional apparatus, even if the cooling liquid is sprayed towards the tangent line direction of the inner circumference face of the cooling cylinder body, the cooling liquid collides and rebounds at the inner circumference face of the cylinder body, and the flow running to the inner side in the radius direction from the inner circumference face is generated. Therefore, for the conventional apparatus, it was difficult to make the cooling liquid layer having uniform thickness along the inner circumference face of the cylinder body, thus it was difficult to produce the metal powder having uniform quality (uniform particle size, crystallinity, and shape or so). Particularly, such tendency was prominent when the flow amount of the cooling liquid was increased, and the speed of the cooling liquid was increased.

SUMMARY OF THE INVENTION

The present invention is attained in view of such circumstance, and the object is to provide the metal powder producing apparatus capable of producing high quality metal powder, and the method of producing the metal powder using the apparatus.

In order to attain the above object, the metal powder producing apparatus according to the first aspect of the present invention has a melted metal supplying part discharging a melted metal, a cylinder body provided below the melted metal supplying part, and a cooling liquid layer forming part forming a flow of a cooling liquid for cooling the melted metal discharged from the melted metal supplying part along an inner circumference face of the cylinder body, wherein the cooling liquid layer forming part has a primary pressure reservoir, and the primary pressure reservoir is provided on an outer circumference part of the cylinder body.

In order to attain the above object, the method of producing the metal powder according to the first aspect of the present invention has steps of forming a flow of cooling liquid along the inner circumference face of the cylinder body provided below the melted metal supplying part, and discharging the melted metal from the melted metal supplying part towards the flow of the cooling liquid, wherein a temporarily retained cooling liquid flows against the gravity towards up from bottom of the axial direction of a pressure reservoir part provided to the outer circumference part of the cylinder body to increase a static pressure of the cooling liquid, then the cooling liquid is discharged along the inner circumference face of the cylinder body and the gravity also acts to the discharged cooling liquid.

For the metal powder producing apparatus according to the first aspect of the present invention and for the method of producing the metal powder, the temporarily retained cooling liquid flows against the gravity towards up from bottom of the axial direction of the pressure reservoir part placed to the outer circumference part of the cylinder body to increase the static pressure, then the cooling liquid is discharged along the inner circumference face of the cylinder body, thereby the gravity acts on the discharged cooling liquid as well. Thus, even if the flow amount of the cooling liquid is increased or the speed of the cooling liquid is increased, the cooling liquid layer having uniform thickness along the inner circumference face of the cylinder body can be easily formed, and high quality metal powder can be easily produced.

In order to attain the above mentioned object, the metal powder producing apparatus according to the second aspect of the present invention has a melted metal supplying part discharging the melted metal, a cylinder body provided below the melted metal supplying part, and a cooling liquid layer forming part forming a flow of the cooling liquid for cooling the melted metal discharged from the melted metal supplying part along the inner circumference face of the cylinder body, wherein the cooling liquid layer forming part has a primary pressure reservoir placed to the outer circumference side of a nozzle opening for cooling liquid opening to the inner circumference face of the cylinder body, and a secondary pressure reservoir placed to the inner circumference side of the nozzle opening.

In order to attain the above object, the method of producing the metal powder according to the second aspect of the present invention has steps of forming the flow of the cooling liquid along the inner circumference face of the cylinder body provided below the melted metal supplying part, and discharging the melted metal from the melted metal supplying part to the flow of the cooling liquid, wherein the cooling liquid temporarily retained in the pressure reservoir part flows against the gravity and increases the static pressure of the cooling liquid, then the static pressure of the cooling liquid right before discharged from the nozzle opening is even more increased at the inner circumference side of the nozzle opening when the cooling liquid is discharged from the nozzle opening along the inner circumference face of the cylinder body.

In the metal powder producing apparatus according to the second aspect of the present invention and the method of producing the metal powder, the cooling liquid temporarily retained in the pressure reservoir part flows against the gravity and the static pressure of the cooling liquid is increased, and then when the cooling liquid is discharged from the nozzle opening along the inner circumference face of the cylinder body, the static pressure of the cooling liquid can be even more increased at the inner circumference side of the nozzle opening right before it is discharged from the nozzle opening.

Therefore, a static pressure is acting on the cooling liquid discharged from the nozzle opening not only from the outer circumference side but also from the inner circumference side. As a result, even in case the flow amount of the cooling liquid is increased or the speed of the cooling liquid is increased, the cooling liquid layer having uniform thickness can be easily formed along the inner circumference face of the cylinder body, and high quality metal powder can be produced.

In the second aspect of the present invention, preferably the primary pressure reservoir and the secondary pressure reservoir are connected by a connecting passage provided at an upper part of the cylinder body in axial direction.

Preferably, the width of the connecting passage in axial direction is smaller than the width of the primary pressure reservoir in axial direction, and it is preferably ½. By constituting as such, the speed of the cooling liquid running though the connecting passage increases.

In the second aspect of the present invention, preferably the connecting passage is formed by a space between an upper end of the cylinder body and a flow passage forming member, and the flow passage forming member is integrally formed with an outer case defining the primary reservoir, or it is installed to the outer case in a removable manner.

In the second aspect of the present invention, preferably the secondary pressure reservoir is formed by an inner frame formed at the inner circumference side of the flow passage forming member and a nozzle edge formed at the lower end of the inner frame. Preferably, the nozzle opening is the space between the nozzle edge and the inner circumference face of the cylinder body.

Preferably, the nozzle edge is provided with a folded end for forming the folded pressure reservoir at a predetermined space between the inner frame and the folded end. By having the folded end, the flow of the cooling liquid discharged from the nozzle opening between the nozzle edge and the inner circumference face is further stabilized and the cooling liquid having uniform thickness along the inner circumference face of the cylinder body can be easily formed.

In the first and second aspects of the present invention, preferably, the vertical width in the axial direction of the primary pressure reservoir can be regulated. By constituting as such, the flow amount of the cooling liquid retained in the primary pressure reservoir can be regulated. Also, at the primary pressure reservoir, single or plurality of width regulator blocks may be provided in a removable manner which enables to regulate the vertical width of the primary pressure reservoir in axial direction.

In the first and second aspects of the present invention, preferably the cooling liquid layer forming part has a spiral flow forming part which allows the cooling liquid to flow in a spiral form against the gravity at the inside of the primary pressure reservoir. For example, the spiral flow forming part is formed by installing a cooling liquid supplying pipe to the outer case which sprays the cooling liquid towards the tangent line direction of the inner circumference face of the outer case constituting the primary pressure reservoir.

The cooling liquid supplying pipe may be installed to plurality of places along the center axis of the primary pressure reservoir, and by selecting the cooling liquid supplying pipe depending on the position of width regulating block installed, the entrance of the cooling liquid introduced into the primary pressure reservoir can be changed. The entrance of the cooling liquid is preferably positioned near the bottom in the axial direction of the primary pressure reservoir formed by the width regulating block, but it is not limited thereto.

DESCRIPTION OF THE EMBODIMENTS

Hereinafter, the present invention will be described based on the embodiments shown in the figure.

First Embodiment

Figure 1:
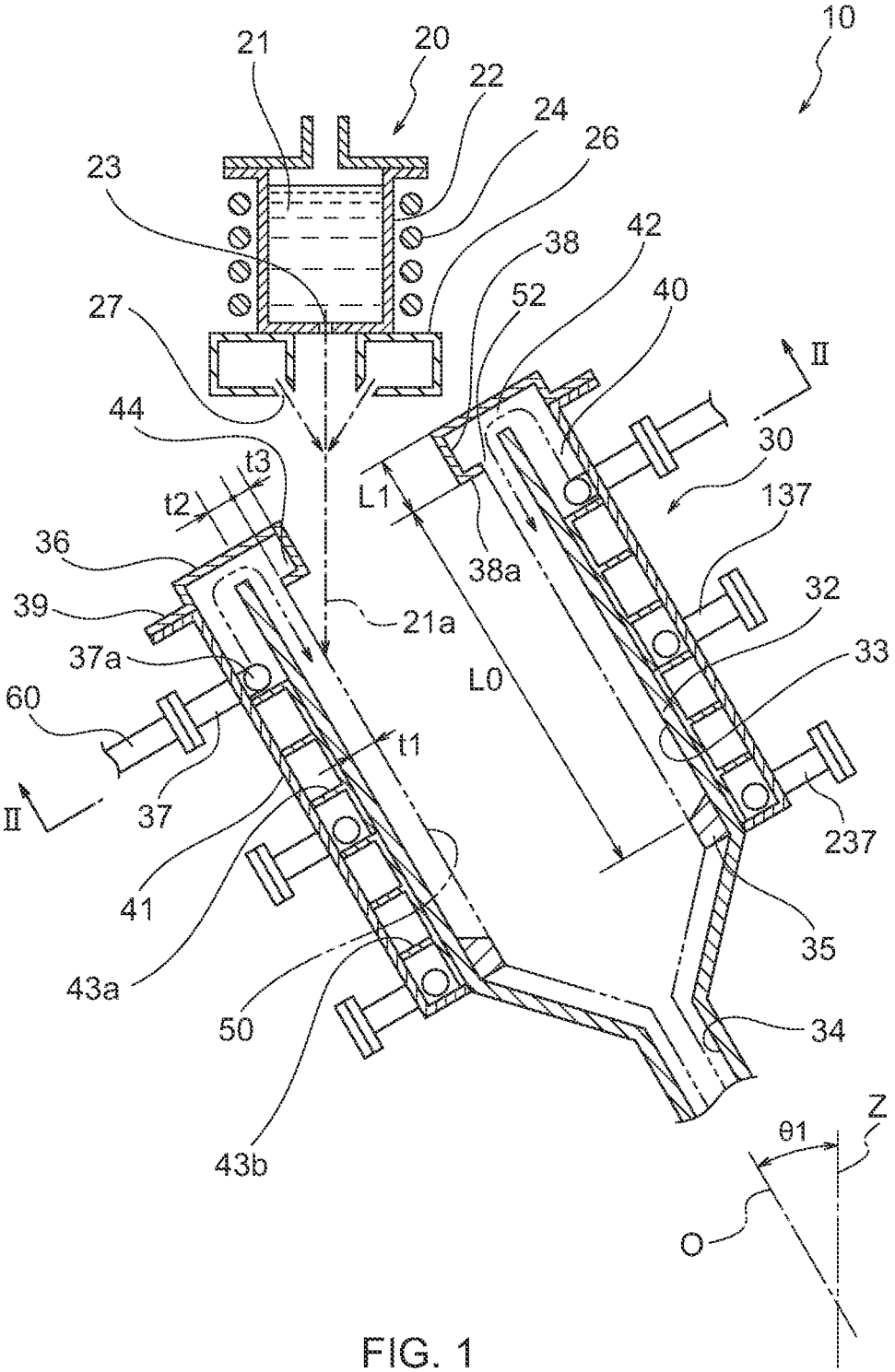
FIG. 1 is a schematic cross section of the metal powder producing apparatus according to one embodiment of the present invention.

As shown in FIG. 1, the metal powder producing apparatus 10 according to one embodiment of the present invention forms the melted metal 21 into a powder by an atomization method, and the metal powder constituted from many metal particles is obtained. This apparatus 10 has the melted metal supplying part 20, the cooling part 30 placed at the bottom in a vertical direction of the metal supplying part 20. In the figure, the vertical direction is the direction along Z axis.

The melted metal supplying part 20 has a heat resistance container 22 which contain the melted metal 21. A heating coil 24 is placed at the outer circumference of the heat resistance container 22, hence the heat resistance container 22 contains the melted metal 21 while heating and keeping it in a melted condition. At a base part of the heat resistance container 22, a discharge opening 23 is formed, and the melted metal 21 is discharged as a melted metal drop 21*a* towards the inner circumference face 33 of the cylinder body 32 constituting the cooling part 30.

At the outer circumference part of the bottom outer wall of the heat resistance container 22, a gas spraying nozzle 26 is placed around the discharge opening 23. At the gas spraying nozzle 26, the gas spraying opening 27 is formed. A high pressure gas is sprayed from the gas spraying opening 27 towards the melted metal drop 21*a* discharged from the discharge opening 23. The high pressure gas is sprayed diagonally downward to the entire circumference of the melted metal discharged from the discharge opening 23, and the melted metal drop 21*a* is formed into many liquid drops, then these move towards the inner circumference face of the cylinder body 32 along the flow of the gas.

The melted metal 21 may include any elements, and for example at least one selected from the group consisting of Ti, Fe, Si, B, Cr, P, Cu, Nb, and Zr may be included. These elements are highly active, and the melted metal 21 including these elements is easily oxidized by contacting air for short period of time and forms an oxide film, hence it was difficult to downsize. The metal powder producing apparatus 10 uses inactive gas as the gas sprayed from the gas spraying opening 27 of the gas spraying nozzle 26 as mentioned in above, hence even in case of the melted metal 21 which easily oxidize, it can be easily formed into powder.

As the gas sprayed from the gas spraying opening 27, an inactive gas such as nitrogen gas, argon gas, helium gas or so, or a reducing gas such as ammonia decomposition gas or so are preferable, but if the melted metal 21 is a metal which hardly oxidize then it may be air.

In the present embodiment, the center axis O of the cylinder body 32 is tilted by a predetermine angle θ1 with respect to the vertical line Z. This predetermine angle θ1 is not particularly limited, and preferably it is 5 to 45 degrees. By having the angle within this range, the melted metal drop 21*a* can be easily discharged from the discharge opening 23 to the cooling liquid layer 50 formed to the inner circumference face 33 of the cylinder body 32.

The melted metal drop 21*a* discharged to the cooling liquid layer 50 collides with the cooling liquid layer 50, then fragmented and refined. Also, at the same time it is solidified by cooling, and forms solid metal powder. At the lower side along the center axis O of the cylinder body 32, the discharge part 34 is provided, and the metal powder included in the cooling liquid layer 50 can be discharged to outside together with the cooling liquid. The metal powder discharged together with the cooling liquid is separated from the cooling liquid by external reservoir and then removed. Note that, the cooling liquid is not particularly limited, and the cooling water may be used.

At the downstream side of the cooling liquid layer 50, a dam ring 35 is fixed to the inner circumference face 33 of the cylinder body 32. By providing the dam ring 35 to the downstream side of the cooling liquid layer 50, due to the synergistic effect with the inner frame 38 which will be described in below, the thickness t1 of the cooling liquid layer 50 can be maintained constant easily.

Note that, in case of only using the dam ring 35, if the speed or the flow amount of the cooling liquid is increased, it was difficult to maintain the thickness t1 of the cooling liquid layer 50 constant. Also, in the present embodiment, the thickness t1 of the cooling liquid layer 50 can be maintained constant without the dam ring 35; however by having the dam ring 35, the thickness t1 can be maintained constant more easily.

In the present embodiment, at the outer circumference part of the cylinder body 32, the outer case 41 as the cooling liquid layer forming part is provided to the cylinder body 32 such that the center axis of the outer case 41 and the center axis of the cylinder body 32 match. Preferably, the outer case 41 is provided to the cylinder body 32 in a removable manner.

In between the outer case 41 and the cylinder body 32, a ring form space is formed, and if necessary, single or plurality of width regulating blocks 43*a* and 43*b* are provided to the ring form space at the lower side along the center axis O. The space on the upper side where the width regulating blocks 43*a* and 43*b* are not provided is the primary pressure reservoir 40.

The cooling liquid supplying pipe 37 is connected to the outer case 41 so that the supplying opening 37*a* is connected with the pressure reservoir 40 near the lower position in O axis direction of the primary pressure reservoir 40 provided with the two width regulating blocks 43*a* and 43*b* aligning next to each other from the lower side in the center axis O direction at the inside of the outer case 41. In the present embodiment, an external supplying line 60 is connected to the cooling liquid supplying pipe 37 for actually supply the colluding liquid.

Figure 2:
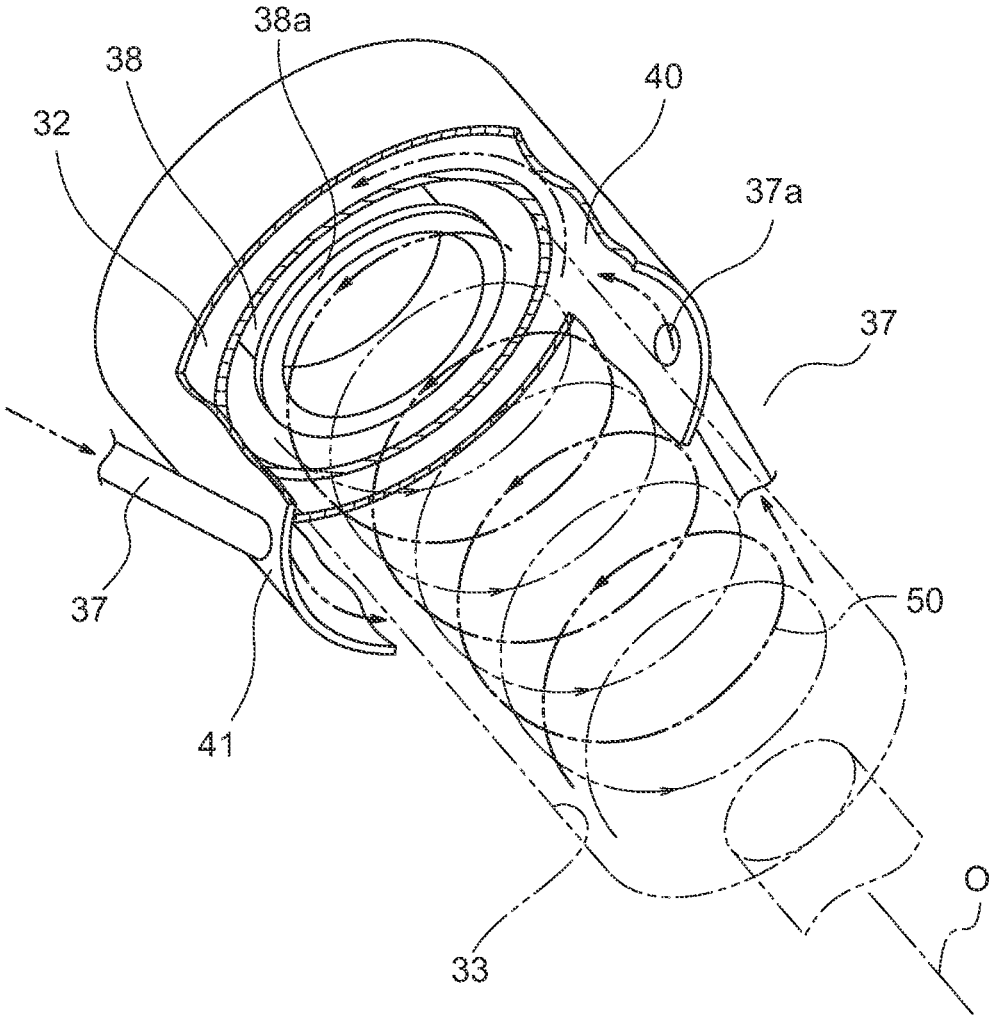
FIG. 2 is a perspective view of the partial cross section along II-II line shown in FIG. 1.

As shown in FIG. 2, the cooling liquid supplying pipe (the spiral flow forming part) 37 is provided to plurality of places in circumference direction of the outer case 41 so that the cooling liquid is sprayed from the supplying opening 37*a* to the tangent line direction of the inner circumference face of the outer case 41 constituting the primary pressure reservoir 40. The cooling liquid supplied from the supplying opening 37*a* flows upwards in a spiral form against the gravity along the center axis O at the inside of the primary pressure reservoir 40.

As shown in FIG. 1, the outer case 41 is provided with plurality of the cooling liquid supplying pipes 137 and 237 at plurality of positions in the center axis direction along the circumference direction, and as shown in FIG. 1, the cooling liquid supplying pipes 137 and 237 are covered by a lid and not used. For example, the cooling liquid supplying pipe 137 is provided to the outer case 41, so that it is positioned near the base of the primary pressure reservoir 40 having enlarged vertical width in center axis direction while the width regulating block 43*a* placed at the upper side of the center axis O is removed from the inside of the outer case 41. Also, for example, the cooling liquid supplying pipe 237 is provided to the outer case 41 so that it is positioned near the base of the primary pressure reservoir 40 having enlarged vertical width in the center axis direction while the width regulating blocks 43*a* and 43*b* are both removed from the inside of the outer case 41.

Figure 3:
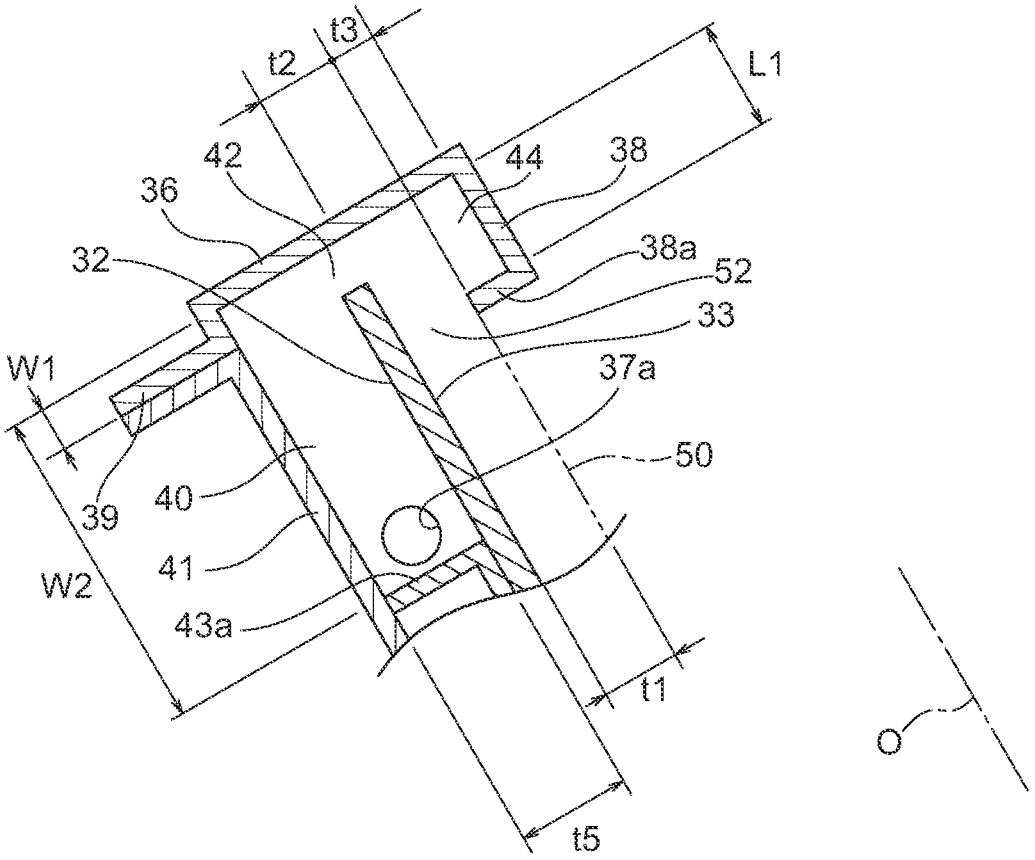
FIG. 3 is an enlarged cross section of an essential part of the metal powder producing apparatus shown in FIG. 1.

In the present embodiment, the vertical width W2 in center axis O direction of the primary pressure reservoir 40 shown in FIG. 3 can be regulated by removing the width regulating blocks 43*a* and/or 43*b* shown in FIG. 1. Here, by changing the connection between the external supplying line 60 and the cooling water supplying pipes 37, 137, and 237, the position of the cooling liquid supplied to the primary pressure reservoir 40 can be changed. Note that, while the vertical width W2 of the primary pressure reservoir 40 is enlarged by removing the width regulating blocks 43*a* and/or 43*b*, the cooling liquid may be introduced in a spiral form to the inside of the primary pressure reservoir 40 from the supplying opening 37*a* of the cooling water supplying pipe 37.

In the present embodiment, a flange part 39 of a flow passage forming member 36 as the cooling liquid layer forming part is installed in a removable manner to the upper end along the center axis O of the outer case 41. However, it does not have to be in a removable manner, and it may be integrally formed with the outer case 41.

In the present embodiment, the flow passage forming member 36 is constituted by a member having approximate ring plate form member, and at the inner circumference end thereof, the inner frame of cylinder form is formed approximately coaxially with the cylinder body 32. The inner diameter of the inner circumference face of the inner frame 38 is smaller than the inner diameter of the inner circumference face 33 of the cylinder body 32. The space between the upper end of the cylinder body 32 and the inner face of the flow passage forming member 36 of a ring plate form is a ring form, and constitute the connecting passage 42. The connecting passage 42 faces to the inner frame 38 while having predetermined width in between.

At the lower end part along the center axis O of the inner frame 38, the nozzle edge (the cooling liquid layer forming part) 38*a* is formed. In the present embodiment, the nozzle edge 38*a* has a ring plate form extending outwards in radial direction which is approximately perpendicular against the center axis O from the lower end of the inner frame 38; and the space between the outer circumference end of the nozzle edge 38*a* and the inner circumference face 33 constitutes the ring form nozzle opening 52. As shown in FIG. 3, a radial direction width t2 of the nozzle opening 52 is not particularly limited, and it is determined in the relation with the thickness t1 of the cooling liquid layer 50, and preferably it is 1 to 50 mm. Also, the width t2 may be thinner than the thickness t1.

Also, the nozzle edge 38*a* protrudes out in radial direction from the inner circumference face 33 and the inner frame 38 which is concentric with the inner circumference face 33; thereby the secondary pressure reservoir 44 opposing the connecting passage 42 is formed at the inner side of the connecting passage 42. The capacity of the secondary pressure reservoir 44 is determined based on the length L1 along the center axis O of the inner frame 38 and the radial direction width t3 of the nozzle edge 38*a*. As the radial direction width t3 of the nozzle edge 38*a* increases, the capacity of the secondary pressure reservoir 44 increases, and the function as the pressure reservoir is enhanced, but the opening area allowing the melted metal drop 21*a* shown in FIG. 1 to enter the inside of the cylinder body 32 tends become narrower. The radial direction width t3 of the nozzle edge 38*a* needs to be compared with the opening area allowing the melted metal drop 21*a* to enter the inside of the cylinder body 32, and preferably it is 1 mm to 50 mm.

In the secondary pressure reservoir 44, the cooling liquid running towards the inner side of the radial direction from the connecting passage 42 collides to the inner frame 38, and the flow to the upper side along the center axis O is limited in the flow passage forming member 36, further the flow to the lower side along the center axis O is limited at the nozzle edge 38*a*. Therefore, the cooling liquid discharged from the connecting passage 38*a* to the inner side in the radial direction will have increased pressure (static pressure) at the secondary pressure reservoir 44, and it is stably discharged in a high speed from the nozzle opening 52 along the inner circumference face, hence the cooling liquid layer 50 having constant thickness t1 along the center axis O at the inner side of the inner circumference face 33 can be formed.

As shown in FIG. 1, the axial direction length L1 of the inner frame 38 may be about the length covering the connecting passage 42, and the liquid surface of the cooling liquid layer 50 having sufficient axial direction length L0 is exposed to the inner circumference face 33 of the cylinder body 32. The axial direction length L0 of the cooling liquid layer 50 exposed to the inner side is preferably 5 to 500 times longer than the axial direction length L1 of the inner frame 38. Also, the inner diameter of the inner circumference face 33 of the cylinder body 32 is not particularly limited, and preferably it is 50 to 500 mm. In the present embodiment, the outer case 41 is provided to the outer circumference side of the cylinder body 32 which is formed with the cooling liquid layer 50 having sufficient axial direction length L0.

In the present embodiment, the primary pressure reservoir 40 and the secondary pressure reservoir 44 are connected by the narrow connecting passage 42, and the secondary pressure reservoir 44 is placed at the inner circumference side of the ring form nozzle opening 52, and the primary pressure reservoir 40 is placed at the outer circumference side of the nozzle opening 52. The vertical width W1 of the connecting passage 42 in the center axis O direction is narrower than the vertical width W2 of the primary pressure reservoir 40 in center axis O direction, and smaller than the vertical width L1 of the secondary pressure reservoir 44.

W1 is 0.01 mm or more and 5 mm or less, and preferably 0.1 mm or more and 3 mm or less. W1/W2 is preferably ½ or less. If W1 is too narrow, the flow resistance becomes too large, and if W1 is too large, the function of the primary pressure reservoir 40 as the pressure reservoir of the cooling liquid tends to decline. Also, L1 is 10 mm or more and 100 mm or less, and preferably 30 to 70 mm. If L1 is too long, the melted metal drop 21*a* collides to the inner frame 38 when entering the inside of the cylinder body 32. Also, if L1 is too short, the secondary pressure reservoir 44 cannot function. Further, the radial direction width t5 of the primary pressure reservoir 40 is determined by the liquid amount retained in the primary pressure reservoir 40.

As shown in FIG. 2, in the present embodiment, the cooling liquid supplying pipe 37 as the spiral flow forming part is connected to the outer case 41 at plurality of places in the circumference direction. The cooling liquid rotates around the center axis O and enters to the inside of the primary pressure reservoir 40 from the supplying opening 37*a* of the cooling liquid supplying pipe 37. The cooling liquid rotating around the center axis O at the inside of the primary pressure reservoir 40 flows upwards of the center axis O against the gravity in a spiral form. Then, it flows to the inner side in radial direction from the inner circumference face 33 through the connecting passage 42, and collides to the inner circumference face of the inner frame 38, and then the pressure is increased in the secondary pressure reservoir 44. Then, it is discharged along the inner circumference face 33 of the cylinder body 32 through the nozzle opening 52.

The rotating flow of the cooling liquid which is continuously supplied to the inside of the primary pressure reservoir 40 from the cooling liquid supplying pipe 37, and the flow of the cooling liquid along the inner circumference face 33 of the cylinder body 32 generated by the gravity acting on the cooling liquid forms the spiral flow as shown in FIG. 2, thereby the cooling liquid layer 50 is formed. The melted metal drop 21*a* shown in FIG. 1 enters to the inner circumference side liquid surface of the cooling liquid layer 50 formed as such, and the melted metal drop 21*a* is cooled while flowing together with the cooling liquid at the inside of the cooling liquid layer 50 which has a spiral flow.

In the metal powder producing apparatus 10 according to the present embodiment and the method of producing the metal powder using the metal powder producing apparatus 10, the cooling liquid which has been temporarily retained flows against the gravity from the bottom to up in the center axis direction of the primary pressure reservoir part 40 placed at the outer circumference part of the cylinder body 32, and the static pressure of the cooling liquid is increased. Then, when the cooling liquid is discharged from the nozzle opening 52 along the inner circumference face 33 of the cylinder body 32, the static pressure of the cooling liquid right before discharged from the nozzle opening 52 can be further increased at the inner circumference side of the nozzle opening 52. The static pressure not only acts to the cooling liquid discharged from the nozzle opening 52 to the inner circumference face 33 from the outer circumference side but also from the inner circumference side, and the gravity also acts to the discharged cooling liquid flowing in a spiral form. Therefore, in case of increasing the flow amount of the cooling liquid or in case of increasing the speed of the cooling liquid, the cooling liquid layer having uniform thickness along the inner circumference face of the cylinder body can be easily formed, thus high quality metal powder can be produced.

Further, in the present embodiment, the inner frame 38 is provided to the upper part of the center axis O of the cylinder body 32. By constituting as such, the inner frame 38 can be easily placed to the upstream side of the position where the melted metal discharged from the metal supplying part 20 contacts the cooling liquid.

Further, as shown in FIG. 2, in the present embodiment, the cooling liquid supplying pipe (or nozzle) 37 is connected in the tangent line direction of the outer case 41 continuous in circumference direction, thereby the cooling liquid rotates around the center axis O and enters to the inside of the primary pressure reservoir 40 from the cooling liquid supplying pipe 37. The spiral flow formed in the primary pressure reservoir 40 continues in the connecting passage 42, the secondary pressure reservoir 44, and the nozzle opening 52, hence the cooling liquid 50 of spiral flow having uniform thickness along the inner circumference face 33 can be formed.

Second Embodiment

Figure 4:
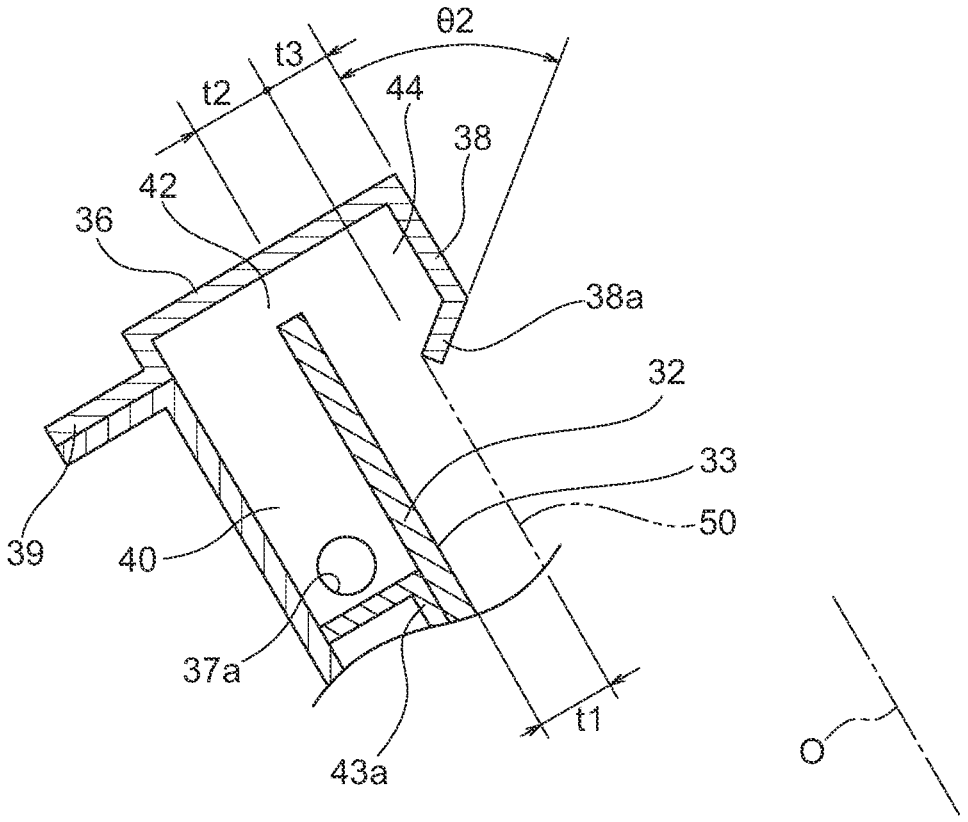
FIG. 4 is an enlarged cross section of the essential part of other embodiment of the present invention.

As shown in FIG. 4, the metal powder producing apparatus according to other embodiment of the present invention is same as the first embodiment except for the followings, and the parts which are same as the first embodiment will be omitted from explaining. Also, the same names and numbers are given to the same members.

In the first embodiment, the nozzle edge 38*a* is perpendicular with respect to the inner frame 38 (or with respect to the center axis O). However, in the present embodiment it is not necessarily perpendicular, and tilted by inclination angle θ2.

In the present embodiment, the inclination angle (taper angle) 02 of the nozzle edge 38*a* with respect to the inner frame 38 or the center axis O is not particularly limited, and preferably it is 5 to 45 degrees. By tilting the nozzle edge 38*a* in a taper form towards the lower end in the axial direction, the force pressing the cooling liquid to the inner circumference face 33 acts, hence the cooling liquid layer 50 having uniform thickness t1 along the center axis O of the inner circumference face 33 of the cylinder body 32 can be easily formed.

Third Embodiment

Figure 5:
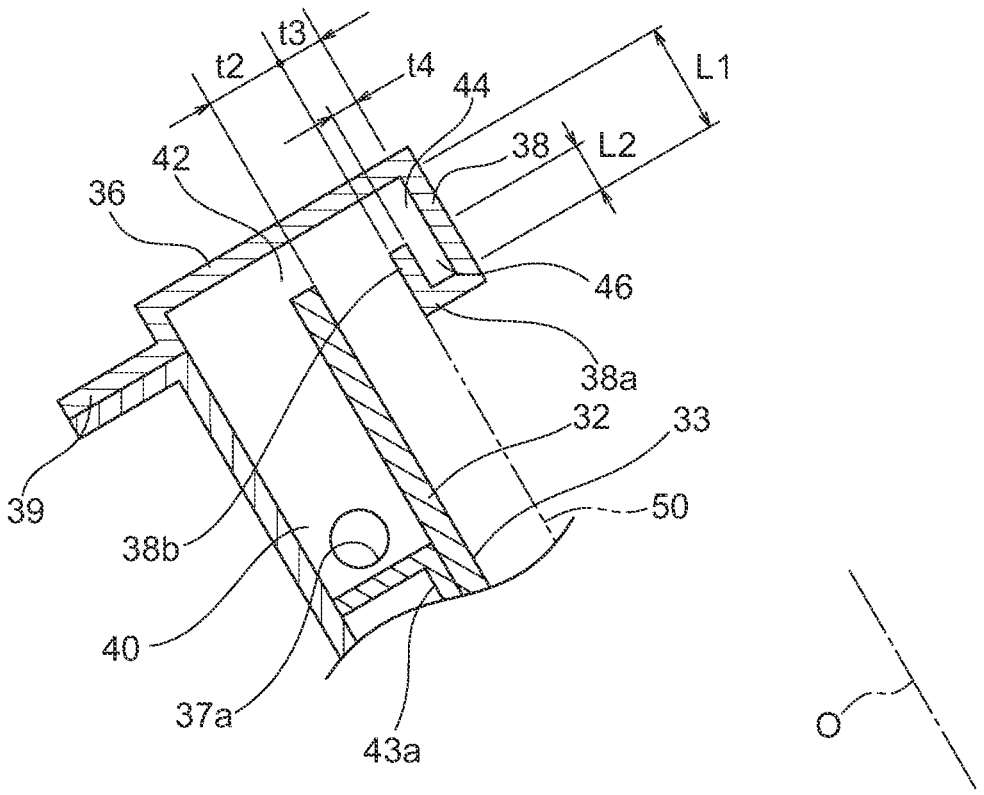
FIG. 5 is an enlarged cross section of the essential part of further other embodiment of the present invention.

As shown in FIG. 5, the metal powder producing apparatus according to other embodiment of the present invention is same as the first and second embodiments except for the followings, and the parts which are same as the first and second embodiments will be omitted from explaining. Also, the same names and numbers are given to the same members.

In the present embodiment, at the tip in the inner diameter side of the nozzle edge 38*a*, the folded end 38*b* is provided which forms the folded pressure reservoir 46 having predetermined radial direction space t4 between the folded end 38*b* and the inner frame 38. In the present embodiment, the folded end 38*b* is formed approximately coaxially with the inner frame 38, but it may be formed into a taper form and tilted with the inner frame 38 provided that the folded pressure reservoir 46 is formed.

The length L2 of the folded end 38*b* along the center axis O is not particularly limited, and preferably it is shorter than the length L1 of the inner frame 38 along the center axis O, and the folded end 38*b* preferably does not block the flow of the cooling liquid to the inner frame 38 from the connecting passage 42. The radial direction space t4 of the folded pressure reservoir 46 is smaller than the radial direction width t3 of the nozzle edge 38*a* by the thickness of the folded end 38*b*.

In the present embodiment, by providing the folding end part 38*b*, the folded pressure reservoir 46 is formed at the lower side of the secondary pressure reservoir 44 along the center axis O, and the flow of the cooling liquid discharged from the nozzle opening 52 is stabilized, and the cooling liquid layer 50 having uniform thickness t1 along the inner circumference face 33 of the cylinder body 32 can be easily formed.

Fourth Embodiment

Figure 6:
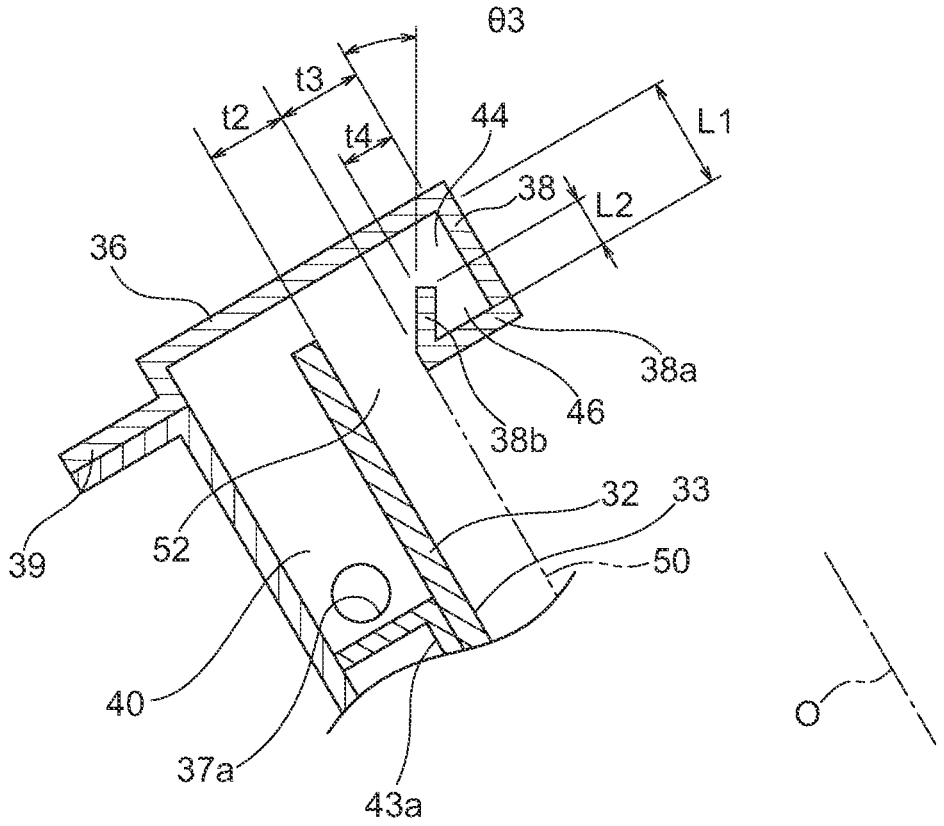
FIG. 6 is an enlarged cross section of the essential part of other embodiment of the present invention.

As shown in FIG. 6, the metal powder producing apparatus according to other embodiment of the present invention is same as the first to third embodiments except for the followings, and the parts which are same as the first to third embodiments will be omitted from explaining. Also, the same names and numbers are given to the same members.

In the third embodiment, the outer circumference face of the folded end 38*b* is formed approximately concentrically with the inner circumference face of the cylinder body 32, and also it is approximately parallel, however in the present embodiment, the outer circumference face of the folded end 38*b* may be tilted by a predetermined angle θ3 with respect to the center axis O. The predetermined angle θ3 is within the range of 0 to ±45 degrees. If 03 is too large in positive direction, then the capacity of the folded pressure reservoir 46 becomes small, and if θ3 is too large in negative direction, then the area of the nozzle opening 52 tends to be too small.

Note that, the present invention is not limited to the above mentioned embodiments and it can be variously modified within the scope of the present invention.

Example

The present invention will be described by referring to the detailed examples, but the present invention is not to be limited to these examples.

(Experiments 1 to 13)

The metal powder producing apparatus 10 shown in FIG. 1 was used, and the inclination angle θ1, the inner diameter (mm), the axial direction length L0, L1, t2, and t3 of the inner circumference face were changed, thereby the cooling liquid layer 50 having a spiral flow of the cooling liquid along the inner circumference face 33 of the cylinder body 32 was evaluated. For the experiments 4 to 13, W1 was 2 mm, and W2 was 200 mm.

For the experiments 1 to 3, the outer case 41 was not provided to the outer circumference of the cylinder body 32, and the supply opening 37*a* of the cooling liquid supplying pipe 37 was provided to the upper part of the center axis O of the cylinder body 32 so that the cooling liquid is discharged in the tangent line direction of the inner circumference face 33.

As the evaluation method, the condition of the spiral flow was visually evaluated, and the thickness of the cooling liquid layer was evaluated. The results are shown in Table 1. In Table 1, when the spiral flow of the cooling liquid layer 50 is barely disturbed, then it is indicated "None"; when turbulent flow was observed it is indicated "Moderate", and if rigorous turbulent flow was observed it is indicated "Rigorous".

According to the comparison of the experiments 1 to 3 (the comparative examples) shown in Table 1, the turbulent flow was formed in the spiral flow due to the increased pump pressure, and the cooling liquid layer having uniform thickness was unable to obtain. On the contrary, the experiments 4 to 13 had the primary pressure reservoir 40 and the secondary pressure reservoir 44; hence a good quality spiral flow with uniform thickness was formed. Also, in the examples, a good quality spiral flow was obtained even when the inner diameter (mm) of the cylinder body, and the inclination angle θ1 were changed.

(Experiments 14 to 16)

The inner frame 38 shown in FIG. 4 is same as the one used in the metal powder producing apparatus shown in FIG. 1 except for changing the nozzle edge 38*a*; and as similar to the experiment 1, the cooling liquid layer 50 having a spiral flow of the cooling liquid along the inner circumference face 33 of the cylinder body 32 was evaluated. The results are shown in Table 2. Even when the taper angle θ2 was changed in order to incline the nozzle edge 38*a* in a taper form towards the lower end in axial direction, the condition of the spiral flow was good.

(Experiments 17 to 19)

The same metal powder producing apparatus 10 as shown in FIG. 1 was used except for changing the inner frame 38 to have the folded end 38*b* as shown in FIG. 5. At the inner diameter side of the nozzle edge 38*a*, the folded end 38*b* is provided for temporarily retaining the cooling liquid by forming the predetermined radial direction space t4 between the inner frame 38 and the folded end 38*b*. As similar to the experiment 1, the cooling liquid layer 50 of a spiral flow of the cooling liquid along the inner circumference face 33 of the cylinder body 32 was evaluated. Except for adding the folded end 38*b*, the experiment was carried out as similar to the experiment 6. The results are shown in Table 3. The condition of the spiral flow was good even when the folded end 38*b* was added.

(Experiments 20 to 22)

The same metal powder producing apparatus 10 as shown in FIG. 1 was used except for changing the inner frame 38 to have the folded end 38*b* as shown in FIG. 6. At the inner diameter side of the nozzle edge 38*a*, the folded end 38*b* is provided for temporarily retaining the cooling liquid by forming the predetermined radial direction space t4 between the inner frame 38 and the folded end 38*b*. For the experiments shown in Table 4, the cooling liquid layer 50 of a spiral flow along the inner circumference face 33 of the cylinder body 32 of the cooling liquid was evaluated as similar to the experiment 17 except for tilting the outer circumference face of the folded end 38*b* by the predetermined angle θ3 with respect to the center axis O. The results are shown in Table 4. The condition of the spiral flow was good even when the folded end 38*b* was tilted by the predetermine angle θ3.

(Experiments 23 to 35)

Using the metal powder producing apparatus 10 shown in FIG. 1, the metal powder made of Fe—Si—B (sample numbers 23 and 28), Fe—Si—Nb—B—Cu (sample numbers 24 and 29), Fe—Nb—B (sample numbers 26, 31, 33 to 35), Fe—Zr—B (sample numbers 27 and 32), and Fe—Si—B—P—Cu (sample numbers 25 and 30) were produced. For each sample, the melting temperature was 1500° C., the gas pressure was 5 MPa, and the used gas was argon; then the water flow condition (including the apparatus) was same as the condition of the experiments No. 2, No. 6, No. 15, No. 18, and No. 21. The results are shown in Table 5.

In the examples, the metal powder having the average particle size of 25 μm was produced. The average particle size was measured using a dry particle size distribution measuring device (HELLOS). Also, the crystal structure analysis of the metal powders produced by the experiments No. 23 to 35 was evaluated by a powder X ray diffraction method. The magnetic characteristic of the metal powder was measured by a coercivity (Oe) using Hc meter.

According to the comparison between the examples and comparative examples of Table 5, the examples had improved magnetic characteristic and amorphous property. The flow of this cooling liquid was regulated by the primary pressure reservoir 40 and the secondary pressure reservoir 44, thus a good quality spiral flow was obtained, and hence it is thought that the uniform cooling effect was obtained. Also, the crystal structure analysis of the metal powder was carried out by the powder X ray diffraction analysis, and some comparative examples had a peak derived from the crystal. Regarding the magnetic characteristic of the metal powder, all of the comparative examples had larger coercivity than the examples, hence it can be confirmed that the examples are better than the comparative examples, and even more uniform cooling effect can be confirmed.

When comparting the above mentioned examples and the comparative examples, by having the primary pressure reservoir 40 and the secondary pressure reservoir 44, the flow of the cooling liquid was regulated without having turbulent flow even when the pump pressure was high, thus uniform cooling effect can be obtained. Also, the amorphous property can be confirmed for the composition which was conventionally unable to produce, and further improved magnetic characteristic can be confirmed.

TABLE 1

| Experiment No | Example/ Comparative example | Inclination angle $\theta_1$ (degree) | Inner diameter (mm) | $L_0$ (mm) | $L_1$ (mm) | t2 (mm) | t3 (mm) | Turbulent flow | Layer thickness (mm) |
|---|---|---|---|---|---|---|---|---|---|
| 1 | Comparative example | 25 | 200 | 600 | 0 | — | — | None | 30 |
| 2 | Comparative example | 25 | 200 | 600 | 0 | — | — | Moderate | 30 |
| 3 | Comparative example | 25 | 200 | 600 | 0 | — | — | rigorous | 30 |

TABLE 1-continued

| Experiment No | Example/ Comparative example | Inclination angle $\theta_1$ (degree) | Inner diameter (mm) | $L_0$ (mm) | $L_1$ (mm) | t2 (mm) | t3 (mm) | Turbulent flow | Layer thickness (mm) |
|---|---|---|---|---|---|---|---|---|---|
| 4 | Example | 25 | 200 | 550 | 50 | 30 | 5 | None | 30 |
| 5 | Example | 25 | 200 | 550 | 50 | 20 | 10 | None | 20 |
| 6 | Example | 25 | 200 | 550 | 50 | 30 | 5 | None | 30 |
| 7 | Example | 25 | 200 | 550 | 50 | 30 | 5 | None | 30 |
| 8 | Example | 25 | 200 | 550 | 50 | 20 | 5 | None | 20 |
| 9 | Example | 25 | 200 | 550 | 50 | 10 | 5 | None | 10 |
| 10 | Example | 25 | 300 | 550 | 50 | 30 | 5 | None | 30 |
| 11 | Example | 25 | 500 | 550 | 50 | 50 | 5 | None | 50 |
| 12 | Example | 5 | 200 | 550 | 50 | 30 | 5 | None | 30 |
| 13 | Example | 45 | 200 | 550 | 50 | 30 | 5 | None | 30 |

| Experiment No | Example/ Comparative example | Taper angle θ2 | t2 (mm) | t3 (mm) | Pump pressure (MPa) | Turbulent flow | Layer thickness (mm) |
|---|---|---|---|---|---|---|---|
| 14 | Example | 5 | 30 | 5 | 7.5 | None | 30 |
| 15 | Example | 45 | 30 | 5 | 7.5 | None | 30 |
| 16 | Example | 60 | 30 | 5 | 7.5 | None | 30 |

TABLE 3

| Experiment No | Example/ Comparative example | Inclination angle $\theta_1$ (degree) | $L_1$ (mm) | $L_2$ (mm) | t2 (mm) | t3 (mm) | t4 (mm) | Turbulent flow | Layer thickness (mm) |
|---|---|---|---|---|---|---|---|---|---|
| 17 | Example | 25 | 50 | 20 | 30 | 5 | 2 | None | 30 |
| 18 | Example | 25 | 50 | 20 | 30 | 10 | 5 | None | 30 |
| 19 | Example | 25 | 50 | 20 | 30 | 20 | 10 | None | 30 |

TABLE 4

| Experiment No | Example/ Comparative example | Taper angle θ3 | Turbulent flow | Layer thickness (mm) |
|---|---|---|---|---|
| 20 | Example | 0 | ○ | 30 |
| 21 | Example | 45 | ○ | 30 |
| 22 | Example | −45 | ○ | 30 |

TABLE 5

| Experiment No | Example/ Comparative example | Sample No | Flow condition No | Composition | Particle diameter (μm) | Crystal structure | Coercivity (Oe) |
|---|---|---|---|---|---|---|---|
| 23 | Comparative example | 1 | 2 | $Fe_{75}Si_{10}B_{15}$ | 25.3 | Amorphous/ Crystal | 5.6 |
| 24 | Comparative example | 2 | 2 | $Fe_{73.5}Si_{13.5}B_9Nb_3Cu_1$ | 25.4 | Amorphous/ Crystal | 10.2 |
| 25 | Comparative example | 3 | 2 | $Fe_{83.3}Si_4B_8P_4Cu_{0.7}$ | 25.8 | Crystal | 170 |
| 26 | Comparative example | 4 | 2 | $Fe_{84}Nb_7B_9$ | 25.9 | Crystal | 180 |
| 27 | Comparative example | 5 | 2 | $Fe_{90}Zr_7B_3$ | 25.6 | Crystal | 253 |
| 28 | Example | 1 | 6 | $Fe_{75}Si_{10}B_{15}$ | 25.2 | Amorphous | 0.35 |
| 29 | Example | 2 | 6 | $Fe_{73.5}Si_{13.5}B_9Nb_3Cu_1$ | 26.1 | Amorphous | 1.35 |
| 30 | Example | 3 | 6 | $Fe_{83.3}Si_4B_8P_4Cu_{0.7}$ | 24.8 | Amorphous | 1.61 |
| 31 | Example | 4 | 6 | $Fe_{84}Nb_7B_9$ | 25.2 | Amorphous | 1.42 |
| 32 | Example | 5 | 6 | $Fe_{90}Zr_7B_3$ | 24.5 | Amorphous | 1.72 |
| 33 | Example | 4 | 15 | $Fe_{84}Nb_7B_9$ | 25.7 | Amorphous | 1.45 |
| 34 | Example | 4 | 18 | $Fe_{84}Nb_7B_9$ | 25.4 | Amorphous | 1.32 |
| 35 | Example | 4 | 21 | $Fe_{84}Nb_7B_9$ | 27.3 | Amorphous | 1.54 |

REFERENCE OF NUMERICALS

10 . . . Metal powder producing apparatus
20 . . . Melted metal supplying part
21 . . . Melted metal
22 . . . Container
23 . . . Discharge opening
24 . . . Heating coil
26 . . . Gas spraying nozzle
27 . . . Gas spraying opening
30 . . . Cooling part
32 . . . Cylinder body
33 . . . Inner circumference face
34 . . . Discharge part
35 . . . Dam ring
36 . . . Flow forming part (cooling liquid layer forming part)
37 . . . Cooling liquid supplying pipe (spiral flow forming part)
37*a* . . . Supplying opening
38 . . . Inner frame (cooling liquid layer forming part)
38*a* . . . Nozzle edge (cooling liquid layer forming part)
38*b* . . . Folded end
39 . . . Flange
40 . . . Primary pressure reservoir
41 . . . Outer case
42 . . . Connecting passage
43*a*, 43*b* . . . Width regulating block
44 . . . Secondary pressure reservoir
46 . . . Folded pressure reservoir
50 . . . Cooling liquid layer
52 . . . Nozzle opening
60 . . . External supplying line

The invention claimed is:

1. A method of producing a metal powder comprising steps of forming a flow of a cooling liquid along an inner circumference face of a cylinder body that is below a melted metal supplying part in an up-downward direction, and discharging a melted metal from the melted metal supplying part to interact with the flow of the cooling liquid, wherein:

a primary pressure reservoir for the cooling liquid is (i) on an exterior of the cylindrical body and (ii) has an outlet for the cooling liquid;

the cooling liquid is supplied to the primary pressure reservoir below the outlet;

the cooling liquid flows upward in the primary pressure reservoir to the outlet after being supplied to the primary pressure reservoir; and the cooling liquid flow is directed to make a U-turn from an upward direction in the primary pressure reservoir to a downward direction to flow along the inner circumference face of the cylinder body.

2. The method of producing a metal powder according to claim 1, wherein:

the cooling liquid is directed from the outlet of the primary pressure reservoir by a connecting passage to a secondary pressure reservoir;

the secondary pressure reservoir is radially inward from the primary pressure reservoir; and the cooling liquid is discharged from the secondary pressure reservoir to the inner circumference face.

3. The method of producing a metal powder according to claim 2, wherein the secondary pressure reservoir includes a folded pressure reservoir extending downwardly.

4. The method of producing a metal powder according to claim 2, wherein the primary pressure reservoir has an axial depth (W2) that is at least twice the axial width (W1) of the connecting passage.

5. The method of producing a metal powder according to claim 4, wherein the axial depth (W2) of the primary pressure reservoir and/or a position of the supply of the cooling liquid to the primary pressure reservoir in an axial direction of the primary pressure reservoir is variable.

6. The method of producing a metal powder according to claim 1, wherein:

the cooling liquid is supplied to the primary pressure reservoir via a supplying opening in a wall of the primary pressure reservoir; and the cooling liquid flows in a spiral direction inside the primary pressure reservoir.

* * * * *